US006814269B1

(12) United States Patent
Fernandez

(10) Patent No.: US 6,814,269 B1
(45) Date of Patent: Nov. 9, 2004

(54) APPAREL FOLDING DEVICE

(75) Inventor: Juan Fernandez, Towaco, NJ (US)

(73) Assignee: Products of Tomorrow, Inc., Towaco, NJ (US)

( * ) Notice: Subject to any disclaimer, the term of this patent is extended or adjusted under 35 U.S.C. 154(b) by 0 days.

(21) Appl. No.: 10/273,017

(22) Filed: Oct. 17, 2002

Related U.S. Application Data

(63) Continuation-in-part of application No. 29/162,790, filed on Jun. 20, 2002, now Pat. No. Des. 475,193.

(51) Int. Cl.[7] ..... A41H 33/00
(52) U.S. Cl. ..... 223/37
(58) Field of Search ..... 223/37, 38; 16/254

(56) References Cited

U.S. PATENT DOCUMENTS

| | | | | |
|---|---|---|---|---|
| 924,761 A | | 6/1909 | Goodman | |
| 1,657,551 A | | 1/1928 | Schremp | |
| 3,989,172 A | | 11/1976 | Wiedemann et al. | |
| 5,011,052 A | * | 4/1991 | Craig | 223/37 |
| 5,154,329 A | | 10/1992 | Dorfmueller | |
| 5,257,721 A | * | 11/1993 | Smith et al. | 220/533 |
| 5,417,641 A | | 5/1995 | Warren | |
| 5,947,349 A | | 9/1999 | Shaalan | |
| 6,056,170 A | | 5/2000 | Lizarbe | |
| 6,237,761 B1 | | 5/2001 | Godshaw et al. | |
| 6,279,791 B1 | | 8/2001 | Betman et al. | |
| 6,360,927 B1 | | 3/2002 | Barker | |
| 6,508,357 B1 | | 1/2003 | Faircloth et al. | |

OTHER PUBLICATIONS www.fastfold.com/product.html, 3 pages.
www.flipfold.com, 9 pages.
oddjobstores.com/deals5.html, 1 page.

* cited by examiner

*Primary Examiner*—John J. Calvert
*Assistant Examiner*—James G Smith
(74) *Attorney, Agent, or Firm*—Lerner, David, Littenberg, Krumholz & Mentlik, LLP

(57) ABSTRACT

An apparel folding device suitable for folding apparel in a quick and consistent manner is disclosed. The device comprises a first panel hingedly connected to two side panels located on opposing sides. A bottom panel hingedly connected to the first panel may also be provided between the two side panels. The bottom panel and two side panels may each include a lipped handle. In addition, each of the two side panels may be constructed from two sub-panels. This permits the device to be shipped in a more compact and smaller package. The entire apparatus lays flat against a work surface when in its unfolded condition. The bottom panel and two side panels may include a raised member to facilitate grasping of the panel. By manipulating the panels in a predetermined order, apparel may be folded.

18 Claims, 3 Drawing Sheets

APPAREL FOLDING DEVICE

CROSS-REFERENCE TO RELATED APPLICATIONS

This application is a Continuation-In-Part of and claims the benefit of application Ser. No. 29/162,790 filed on Jun. 20, 2002, now U.S. Pat. No. D. 475,193 and incorporates the disclosure of same by reference.

BACKGROUND OF THE INVENTION

The present invention relates to apparel folding devices. More particularly, the present invention relates to a manually operated device for folding shirts and other articles of apparel in a quick and consistent manner. The device consists of a plurality of panels upon which an unfolded garment may be placed. By successively folding and unfolding the panels in a predetermined pattern, a user may fold the article.

In both a commercial and personal setting, it is often desirable to quickly and efficiently fold shirts, for example, in a compact and uniform matter. In the commercial setting, such folding enables employees to quickly set up aesthetically pleasing garment displays. Also, it is well known that shoppers routinely disrupt the uniform appearance of folded garments on display while browsing through stores. It is thus very important for an employee to be able to recompile clothing displays quickly and efficiently, throughout the shopping day.

Other commercial settings also call for the quick and efficient folding of shirts. For example, a commercial silk screener may have an order for a number of shirts in which a particular design may be placed. Prior to packaging and delivering the shirts, it is often desirable to fold the shirts in a uniform manner, perhaps even with the silk screened image exposed. Thus, when received by the final customer, a neat and orderly appearance is maintained.

In the personal setting, many homemakers are also desirous of folding shirts quickly, efficiently and in a uniform manner. This is especially true where shirts may be placed on shelves, which are visible to the home's occupants and guests, but may also be the case where such shirts are to be placed in a drawer. For large families, the need for efficiency is increased.

Various devices have been created to assist with the folding of garments in a quick, efficient and uniform manner. Despite these devices, there remains a need for a simple, inexpensive and efficient apparel folding device. There also remains a need for an apparel folding device that may be shipped in a compact manner.

SUMMARY OF THE INVENTION

The present invention addresses these needs. One embodiment of the apparel folding device of the present invention comprises a panel having first and second side edges, a first side panel hingedly engaged with the panel along its first side edge, and a second side panel hingedly engaged with the panel along its second side edge. At least one of the first side panel and the second side panel includes a handle member, such as a lipped handle, that extends above the surface of the respective side panels. An article of apparel may be folded using the apparel folding device by placing the article of apparel on the device and successively flipping and unflipping the first side panel and second side panel.

The apparel folding device may also comprise first and second end edges with a bottom panel hingedly engaged to the panel along its second end edge. If so provided, at least one of the bottom panel, the first side panel, and the second side panel may include a handle member that extends above the surface of the respective panel. An article of apparel may be folded using the apparel folding device by placing the article on the device and successively flipping and unflipping the first side panel, said second side panel and bottom panel.

The bottom panel may include a handle member that extends above the surface of the bottom panel. If so provided, at least one of the first side panel and the second side panel may include a cut out adapted to permit the handle member of the bottom panel to protrude therefrom when the respective side panel is folded.

The first side panel may comprise a first upper side panel and a first lower side panel and a second side panel may comprise a second upper side panel and a second lower side panel. The first upper side panel may be capable of being connected to the first lower side panel and the second upper side panel may be capable of being connected to the second lower side panel. The first upper side panel may also be detached from the first lower side panel and the second upper side panel may also be detached from the second lower side panel.

The first side panel may also comprise a first upper side panel and a first lower side panel and the second side panel may comprise a second upper side panel and a second lower side panel where the first upper side panel is hingedly engaged with the first lower side panel and the second upper side panel is hingedly engaged with the second lower side panel.

The first upper side panel may include a raised plateau forming a plurality of voids and the first lower side panel may include a plurality of self-locking protrusions extending therefrom. The self-locking protrusions may engage the voids to firmly attach the first upper side panel to the first lower side panel. The self-locking protrusions may include a first extension and a second extension. The first extension may comprise an elongated first extension first section adjacent to the first lower side panel at its proximal end and a first under cut at its distal end. The first extension and second extension may be separated by a gap. The raised plateau may be placed above the first lower side panel in engagement with the self-locking protrusions such that the voids are located completely below the under cuts.

As previously stated, the first side panel may comprise a first upper side panel and a first lower side panel and the second side panel may comprise a second upper side panel and second lower side panel. The first upper side panel may be hingedly engaged with the first lower side panel and the second upper side panel may be hingedly engaged with the second lower side panel.

At least one of the panel, first side panel or second side panel of the apparel folding device may include a display surface. If so provided, the bottom panel may also include a display surface.

The first side panel and the second side panel may form apertures therein. If so provided, the bottom panel may also form apertures therein.

In another embodiment, an apparel folding device comprises a panel having first and second side edges, a first side panel hingedly engaged with the panel along the first side edge, and a second side panel hingedly engaged with the panel along the second side edge. The first side panel may comprise a first upper side panel and a first lower side panel and the second side panel may comprise a second upper side panel and a second lower side panel. The first upper side panel and the first lower side panel may be capable of being stacked on one another to form a first stack and the second upper side panel and second lower side panel may be capable of being stacked on one another to form a second stack. The first stack and second stack may be capable of being placed on the panel to facilitate shipping and storage of the apparel folding device. The first upper side panel and first lower side panel may be hingedly engaged to each other at all times. Similarly, the second upper side panel and second lower side panel may be hingedly engaged to each other at all times. In other embodiments, the first upper side panel may be separated from the first lower side panel and the second upper side panel may be separated from the second lower side panel.

The panel of the apparel folding device of this embodiment may also comprise first and second end edges. There may also be provided a bottom panel hingedly engaged with the panel along the second side edge. If so provided, the bottom panel may be capable of being placed upon the panel to facilitate shipping and storage of the apparel folding device.

DETAILED DESCRIPTION OF THE PREFERRED EMBODIMENT

Figure 1:
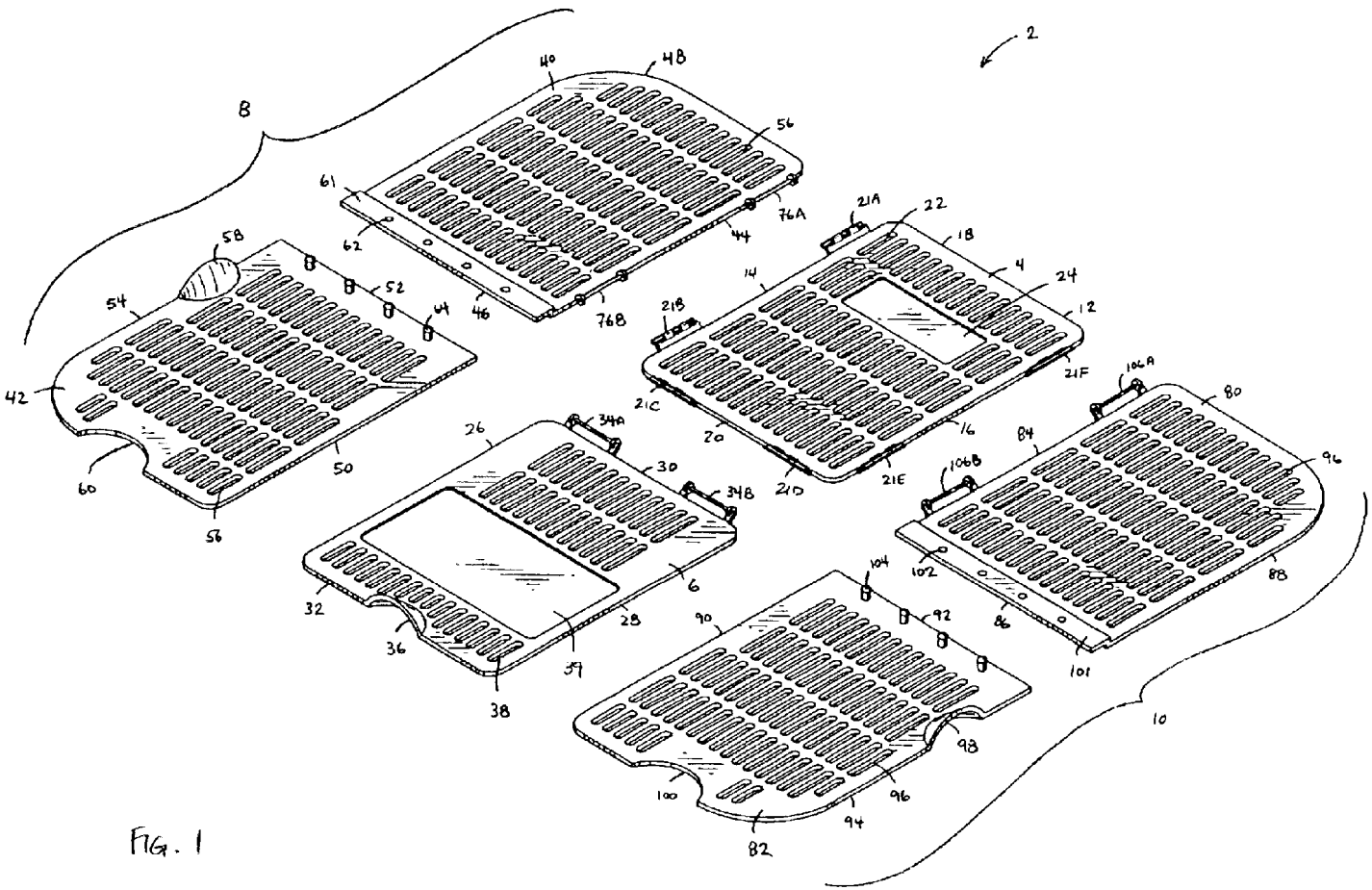
FIG. 1 is an exploded perspective view of an apparel folding device in accordance with the first embodiment of the present invention.

In the following is described the embodiments of the apparel folding device of the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose.

In this context, the apparel folding device may be constructed of any relatively rigid material such as various plastics, metals, woods, or the like. For purposes of this application, however, the apparel folding device will be referred to as if constructed of plastic.

Similarly, many types of garments may be folded using this device. However, this application will generally refer to shirts. Yet, it is to be understood that this device may be used to fold sweaters, pants, shorts and scarves, among other garments.

Finally, it is to be understood that although the invention is hereinafter described with two-part hinges, many hinges may be utilized. For example, depending on the panel material, living hinges may be utilized. Such hinges are commonly known in the industry. They are generally created by the placement of a thin portion of material bridging two heavier portions of the same material. They provide the ability to flex repeatedly without the use of a mechanical hinge. Other hinges contemplated include butt hinges, slip hinges, continuous hinges, flag hinges, liftoff hinges, and many other hinges generally known in the industry. Preferably, the hinges are detachable to facilitate shipping of the apparel folding device.

Referring to the figures, FIG. 1 depicts an exploded perspective view of an apparel folding device in accordance with the first embodiment of the present invention. The apparel folding device 2 preferably comprises a first panel 4, bottom panel 6, and first 8 and second 10 opposing side panels.

The first panel 4 comprises a continuous edge 12. The continuous edge 12 comprises a first edge 14 and an opposing second edge 16. A third edge 18 and opposing fourth edge 20 are oriented transverse to the first and second edges 14, 16 of the first panel 4.

The first edge 14 is adjacent to the first side panel 8, the fourth edge 20 is adjacent to the bottom panel 6, and the second edge 16 is adjacent to the second side panel 10. On each of the first edge 14, fourth edge 20, and second edge 16, there is preferably located a pair of receiving hinges 21A through 21F. More particularly, receiving hinges 21A and 21B are located on first edge 14, receiving hinges 21C and 21D are located on fourth edge 20, and receiving hinges 21E and 21F are located on second edge 16. As will be described hereinafter, the receiving hinges mate with hinged members of the other panels to permit rotation of these other panels relative to the respective edges of the first panel 4. It will also be appreciated that a single hinge of the types previously discussed, particularly living hinges, may be used.

First panel 4 may also preferably contain a series of apertures 22 extending therethrough. The apertures 22 provide weight and material savings while still permitting the panel to have sufficient rigidity for its intended purpose. In addition, the apertures 22 facilitate the folding of apparel when the apparel folding device is in use by permitting air to flow therethrough. This air penetration prevents garments (not shown) from adhering to the panel 4 as it is unfolded. Although shown as slots, the apertures 22 may be in the form of virtually any shape including circles, squares, stars, and the like. The apertures may be dispersed in a uniform pattern, as shown in the figures, or may be randomly dispersed.

First panel 4 also may preferably comprise a display surface 24. The display surface may be utilized to display any number of graphical images, but is typically utilized to display the name of the apparel folding device product 2 and information regarding the manufacturer.

Rotatably engaged along the fourth edge 20 of first panel 4 is bottom panel 6. Bottom panel 6 comprises a first edge 26 and an opposed second edge 28. Third edge 30 and opposed fourth edge 32 are oriented transverse to the first 26 and second 38 edges. The third edge 30, located adjacent to the fourth edge 20 of first panel 4, contains a pair of hinged members 34A and 34B which rotatably engage receiving hinges 21C and 21D of first panel 4. This rotatable engagement permits bottom panel 6 to rotate relative to fourth edge 20 of first panel 4, when so desired.

Along the fourth edge 32 of bottom panel 6 is preferably located lipped handle 36. The lipped handle 36 is a crescent shaped member, which rises from the surface of bottom panel 6. The lipped handle 36 is designed to enable a user to easily grasp bottom panel 6 to facilitate rotation of same. By providing such a raised handle 36, bottom panel 6 may lie completely flat against a work surface (not shown), yet still permit a user to easily grasp it of course, feet capable of lifting the panel 6 may also be provided.

As with first panel 4, bottom panel 6 also comprises a series of apertures 38 and a display surface 39. The apertures 38 are typically identical to the apertures 22 of first panel 4, although they need not be. Further, the display surface 39 of bottom panel 6 is typically similar to the display surface 24 of first panel 4. However, this display surface 39 generally includes graphically illustrated instructions designed to teach a user how to use the apparel folding device 2.

As shown in FIG. 1, adjacent to the first edge 14 of first panel 4 is located first 'side panel 8. In the first, and preferred embodiment of the present invention, side panel 8 is comprised of a first upper side panel 40 and a first lower side panel 42. This permits the panel to be shipped as two separate pieces, thus reducing the length of the package required to ship the device. The first upper side panel 40 comprises a first edge 44 located parallel and adjacent to the first edge 14 of first panel 4. The first upper side panel 40 also comprises a second edge 46 extending perpendicular to the first edge 44. A third edge 48 extends from the end of the second edge 46 opposite to the first edge 44 along an arcuate path and ends at the opposite end of first edge 44. Each of the three edges 44, 46, 48 combine to form an essentially square first upper side panel 40.

The first lower side panel 42 comprises a first edge 50 located parallel and adjacent to the first edge 26 of bottom panel 6. The first lower side panel 42 also comprises a second edge 52 extending perpendicular to the first edge 50, and adjacent to second edge 46 of first upper side panel 40. A third edge 54 extends from the end of the second edge 52 opposite to the first edge 50 along an arcuate path and ends at the opposite end of first edge 50. As shown in FIG. 1A, each of the edges 50, 52, 54, combine to form an essentially square first lower side panel 42.

As with the previous panels, first upper side panel 40 and first lower side panel 42 also preferably contain a series of apertures 56. The apertures 56 are typically identical to the apertures 22 of first panel 4 and 38 of bottom panel 6, although they need not be.

First lower side panel 42 is provided with a lipped handle 58 and an arcuate cutout 60 along its third edge 54. The lipped handle 58 is typically crescent shaped, similar to lipped handle 36 of bottom panel 6. In this regard, the lipped handle 36 is designed to enable a user to easily grasp first lower side panel 42 to facilitate rotation of same. By providing such a raised handle 58, first lower side panel 42 may lie completely flat against a work surface (not shown) of course, feet may also be provided. The arcuate cutout 60 is preferably provided in first lower side panel 42 so that when the panel 42 is rotated towards first panel 4 and bottom panel 6, lipped handle 36 of bottom panel 6 may protrude therethrough. This enables first side panel 8 to lie completely flat against first panel 4 and bottom panel 6, when in a folded condition.

As is show in FIG. 1, the second edge 46 of first upper side panel 40 is raised from the third edge 48 and the first edge 44. The second edge 46 is raised a distance equal to the thickness of first lower side panel 42, and results in the formation of a raised plateau 61 extending from second edge 46. Plateau 61 contains a plurality of circular apertures 62.

Along second edge 52 of first lower side panel 42 are disposed a plurality of self locking protrusions 64. Each self locking protrusion 64 is aligned with an aperture 62 on plateau 61. First upper side panel 40 may be connected to first lower side panel 42 by placing the protrusions 64 of the first lower side panel through the circular apertures 62 of the first upper side panel 40. Such placement will lock the two panels 40, 42 together. It will be appreciated that when the panels 42, 44 are connected, the apparel folding device 2 lays completely flat against a work surface (not shown), when in its open condition, unless feet are provided.

Figure 2:
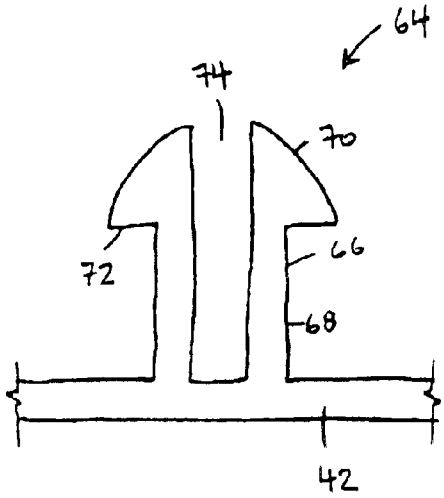
FIG. 2 is an enlarged side elevational view of a self locking protrusion of the present invention.

FIG. 2 depicts a detailed illustration of a self locking protrusion 64. Each self locking protrusions 64 preferably consists of two extensions 66 extending normal to the upper surface of first lower side panel 42. Each extension preferably begins with a first section 68 extending from the first lower side panel 42 and ends with a second section 70. The second section 70 contains an undercut 72. Between each extension 66 lies a gap 74.

In order to connect first upper panel 40 to first lower side panel 42, the circular apertures 62 are placed above the self locking protrusions 64. Upon the application of pressure along the plateau 61 of first upper panel 40, each extension 66 will flex inwards to close gap 74 and the circular apertures will pass over the undercuts 72 to a point adjacent to first section 68. Once the undercuts 72 are cleared, the extensions 66 will spring back to their natural state and the undercuts 72 will prevent first upper side panel 40 from becoming separated from first lower side panel 42 as the undercuts are of a greater diameter than the apertures 62 when in their natural, unflexed condition. It will be appreciated that to achieve the tightest fit possible, the first section 68 of each self locking protrusion 64 is of a length only slightly greater than the thickness of plateau 61.

Referring back to FIG. 1, the first edge 44 of first upper side panel 40 contains a pair of hinged members 76A, 76B. The hinged members 76A, 76B of first upper side panel 40 rotatively engage receiving hinges 21A and 21B of first panel 4. This engagement allows first side panel 8 to freely rotate relative the first edge 14 of first panel 4.

Second side panel 10 is constructed in much the same manner as first side panel 8. However, it will be appreciated that second side panel 10 is located adjacent to second edge 16 of first panel 4.

In the first, and preferred embodiment of the present invention, side panel 10 is comprised of a second upper side panel 80 and second lower side panel 82. The second upper side panel 80 comprises a first edge 84 located parallel and adjacent to the second edge 16 of first panel 4. The second upper side panel 80 also comprises a second edge 86 extending perpendicular to the first edge 84. A third edge 88 extends from the end of the second edge 86 opposite to the first edge 84 along an arcuate path and ends at the opposite of first edge 84. As shown in FIG. 1, each of the three edges 84, 86, 88 combined to form an essentially square second upper side panel 80.

The second lower side panel 82 comprises a first edge 90 located parallel and adjacent to the second edge 28 of bottom panel 6. The second lower side panel 82 also comprises a second edge 92 extending perpendicular to the first edge 90, and adjacent to the second edge 86 of second upper side panel 80. A third edge 94 extends from the end of the second edge 92 opposite to the first edge 90 along an arcuate path and ends at the opposite end of first edge 90. As shown in FIG. 1, each of the edges 90, 92, 94 combine to form an essentially square second lower side panel 82. As with the previous panels, second upper side panel 80 and second lower side panel 82 also contain a series of apertures 96. The apertures 96 are typically identical to the apertures 22 of first panel 4, the apertures 38 of bottom panel 6, and the apertures 56 of first upper side panel 40 and first lower side panel 42, although they need not be.

Second lower side panel 82 is also preferably provided with a lipped handle 98 and an arcuate cutout 100 along its third edge 94. The lipped handle 98 is typically crescent-shaped, similar to the lipped handle 36 of bottom panel 6, and the lipped handle 58 of first lower side panel 42. In this regard, the lipped handle 98 is designed to enable a user to easily grasp second lower side panel 82 to facilitate rotation of same. By providing such a raised handle 98, second lower side panel 82 may lie completely flat against a work surface (not shown), if feet are not provided. The arcuate cutout 100 is preferably provided in second lower side panel 82 so that when the panel 82 is rotated towards first panel 4 and bottom panel 6, lipped handle 36 of bottom panel 6 may protrude therethrough. This enables second side panel 10 to lie completely flat against first panel 4 and bottom panel 6, when in its folded condition.

Although the invention has been described as preferably including crescent-shaped lipped handles 36, 58, 98, it will be appreciated that any member which extends beyond the upper surface of the respective panel will suffice. Crescent-shaped lipped handles are merely preferable.

As with first upper side panel 40, in the preferred embodiment, the second edge 86 of second upper side panel 80 is raised from the third edge 88 and the first edge 84. The second edge 86 is raised a distance equal to the thickness of the lower side panel 82, and results in the formation of a raised plateau 101 extending from second edge 86. Plateau 101 contains a plurality of circular apertures 102.

Along second edge 92 of second lower side panel 82 are disposed a plurality of self locking protrusions 104. Each self locking protrusion is aligned with an aperture 102 on plateau 101. Second upper side panel 80 may be connected to second lower side panel 82 by placing the protrusions 104 of the second lower side panel through the circular apertures 102 of the second upper side panel 80, thus locking the two panels 80, 82 together. It will be appreciated that in the preferred embodiments, when the panels 80, 82 are connected, the apparel folding device 2 lays completely flat against a work surface (not shown), when in its open condition. Of course, feet may be provided on the bottom of the panels, if so desired.

The self locking protrusion 84 of second lower side panel 82 are identical to the self locking protrusions 64 of first lower side panel 42, as shown in FIG. 2.

The first edge 84 of second upper side panel 80 contains a pair of hinged members 106A and 106B. The hinged members 106A and 106B of second upper side panel 80 rotatingly engage receiving hinges 21E and 21F of first panel 4. This engagement allows second side panel 10 to freely rotate relative the second edge 16 of first panel 4.

Figure 3:
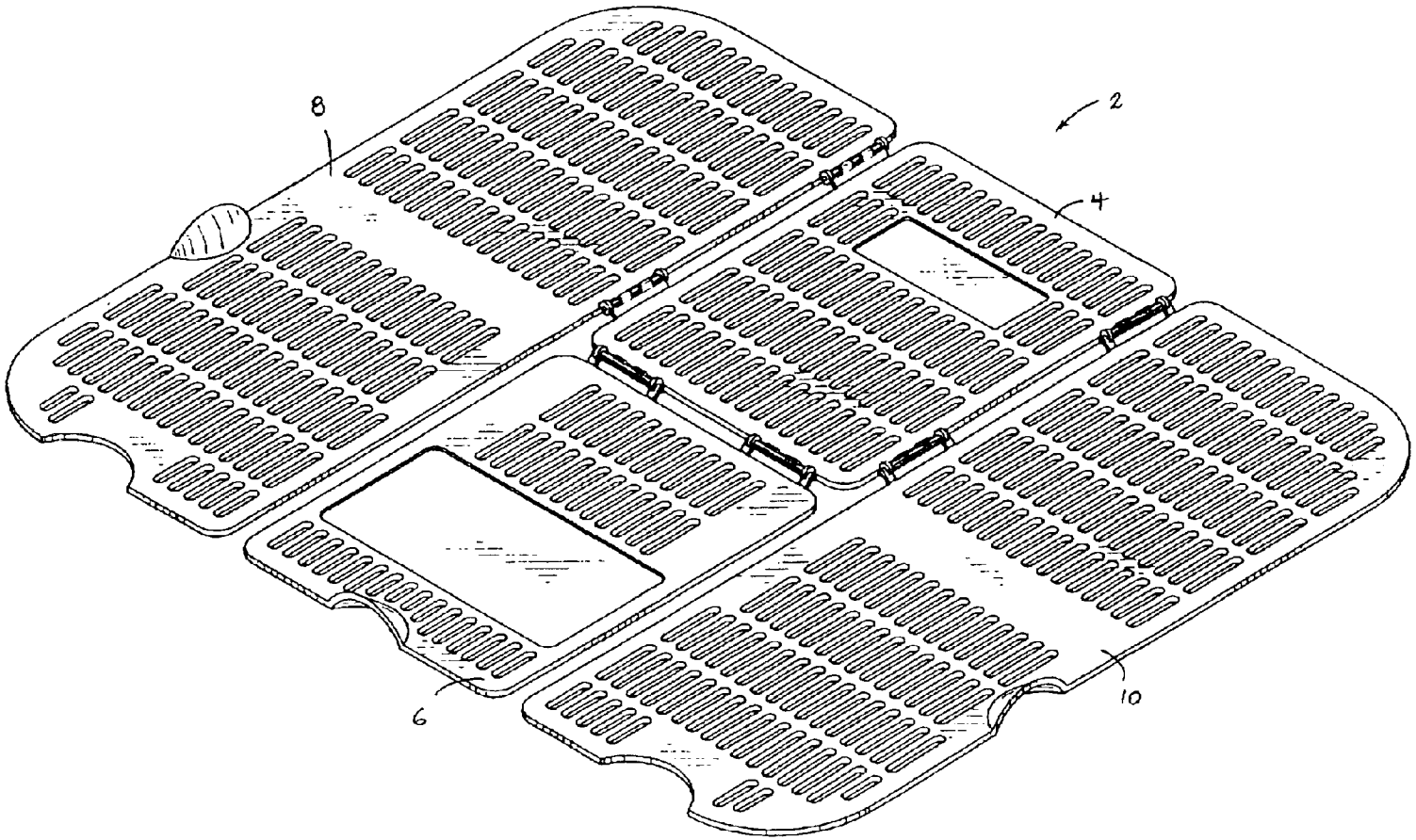
FIG. 3 is a top perspective view of an apparel folding device in accordance with the second embodiment of the present invention.

While FIG. 1 depicts a top prospective view of an apparel folding device in accordance with the first embodiment of the present invention, FIG. 3 depicts a prospective view of a folding device in accordance with the second embodiment of the present invention. In this embodiment, first side panel 8 and second side panel 10 are each formed from a single sheet of material. Typically, this is a result of a single monolithic pour of material. As with the previous embodiment, the apparel folding device of the second embodiment lays completely flat when in its opened condition, unless feet are provided.

The preferred embodiment has the advantage of being shipped in a more compact manner than the second embodiment. For example, in the preferred embodiment, the apparel folding device 2 may be shipped in a box (not shown) which is substantially the same size as first panel 4. In this regard, first upper side panel 40 and first lower side panel 42 will either not be connected to each other, or will be folded along second edge 46 of first upper side panel 40 and second edge 52 of first lower side panel 42. Likewise, second upper side panel 80 and second lower side panel 82 will either be shipped apart from each other, or will be folded together along second edge 86 of second upper side panel 80 and second edge 92 of second lower side panel 82. The four side panels 40, 42, 80, 82 may then be placed upon first panel 4 in a stacked configuration. Finally, bottom panel 6 may be similarly placed on the stack. It will be appreciated that this stack may then be placed in a box (not shown) which is not substantially larger than first panel 4.

In the second embodiment, the apparel folding device 2 must be shipped in a larger box. This box will be approximately the same size as first side panel 8 and first side panel 10, as these side panels are not separable.

In a third embodiment, the apparel folding device 2 may only comprise three panels, namely, first panel 4, first side panel 8 and second side panel 10. It will be appreciated that the remaining aspects of each of these panels may coincide with those found in the first and second embodiments. In this regard, first side panel 8 may comprise first upper side panel 40 and first lower side panel 42, as in the first embodiment, or may be a single panel as in the second embodiment. Similarly, second side panel 10 may comprise second upper side panel 80 and second lower side panel 82, as in the first embodiment, or may be a single panel as in the second embodiment.

To use the apparel folding device 2, a user should place the garment, for example a shirt (not shown), on the unfolded device. After centering the garment (not shown), the user may successively fold and unfold each side panel 8, 10, and then the bottom panel 6 (if provided). This will result in the garment (not shown) being folded. It will be appreciated that to facilitate a user grasping the panels 6 (if provided), 8, 10, each is provided with a lipped handle 36, 58, 98. Apertures 38, 56, 96 may also be provided to permit air to flow through the panels 6 (if provided), 8, 10. This prevents the garment from adhering to the panels 6 (if provided), 8, 10 as they are being unfolded.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An apparel folding device comprising:

a panel having first and second side edges;

a first side panel hingedly engaged with said panel along said first side edge; and a second side panel hingedly engaged with said panel along said second side edge;

wherein at least one of said first side panel and said second side panel includes a handle members having a portion that extends above the top surface of the respective side panel;

whereby an article of apparel may be folded using said apparel folding device by placing said article of apparel on the top surface of said device and successively flipping and unflipping said first side panel and said second side panel.

2. The apparel folding device as claimed in claim 1, wherein said handle member is a lipped handle.

3. The apparel folding device as claimed in claim 1 wherein said panel further comprises first and second end edges;

said apparel folding device further comprising a bottom panel hingedly engaged with said panel along said second end edge;

wherein at least one of said bottom panel, said first side panel and said second side panel includes a handle member having a portion that extends above the top surface of the respective panel; and whereby an article of apparel may be folded using said apparel folding device by placing said article on said device and successively flipping and unflipping said first side panel, said second side panel and said bottom panel.

4. The apparel folding device as claimed in claim 3, wherein said bottom panel includes a handle member having portion that extends above the top surface of said bottom panel; and wherein at least one of said first side panel and said second side panel includes a cutout adapted to permit said handle member of said bottom panel to protrude therefrom when the respective side panel is folded.

5. The apparel folding device as claimed in claims 1 or 3, wherein said first side panel comprises a first upper side panel and a first lower side panel; and said second side panel comprises a second upper side panel and a second lower side panel;

said first upper side panel being capable of being connected to said first lower side panel; and said second upper side panel being capable of being connected to said second lower side panel.

6. The apparel folding device as claimed in claim 5, wherein said first upper side panel is detached from said first lower side panel and said second upper side panel is detached from said second lower side panel.

7. The apparel folding device as claimed in claim 5, wherein said first upper side panel includes a raised plateau forming a plurality of voids and said first lower side panel includes a plurality of self-locking protrusions extending therefrom;

wherein said self-locking protrusions engage said voids to firmly attach said first upper side panel to said first lower side panel.

8. The apparel folding device of claim 7, wherein said self-locking protrusions comprise a first extension and a second extension;

said first extension comprising an elongated first extension first section adjacent to said first lower side panel at its proximal end and a first undercut at its distal end;

said second extension comprising an elongated second extension first section adjacent to said first lower side panel at its proximal end and a second undercut at its distal end;

wherein said first extension and said second extension are separated by a gap.

9. The apparel folding device of claim 8, wherein said raised plateau is above said first lower side panel in engagement with said self-locking protrusions such that said voids are located completely below said undercuts.

10. The apparel folding device as claimed in claims 1 or 3, wherein said first side panel comprises a first upper side panel and a first lower side panel; and said second side panel comprises a second upper side panel and a second lower side panel;

wherein said first upper side panel is hingedly engaged with said first lower side panel and said second upper side panel is hingedly engaged with said second lower side panel.

11. The apparel folding device of claim 1, wherein at least one of said panel, said first said panel or said second side panel includes a display surface.

12. The apparel folding of claim 3, wherein at least one of said panel, said bottom panel, said first side panel or said second side panel includes a display surface.

13. The apparel folding device of claim 1, wherein said first side panel and said second side panel form apertures therein.

14. The apparel folding device of claim 3, wherein said first side panel, said second side panel and said bottom panel form apertures therein.

15. An apparel folding device comprising:

a panel having first and second side edges;

a first side panel hingedly engaged with said panel along said first side edge; and a second side panel hingedly engaged with said panel along said second side edge;

wherein said first side panel comprises a first upper side panel and a first lower side panel and said second side panel comprises a second upper side panel and a second lower side panel and at least one of said first side panel and said second side panel includes a handle member having a portion that extends above the top surface of the respective side panel;

said first upper side panel and said first lower side panel capable of being arranged one on another to form a first stack and said second upper side panel and said second lower side panel capable of being arranged one on another to form a second stack;

said first stack and said second stack capable of being placed upon said panel to facilitate shipping and storage of the apparel folding device in a package smaller than if the side panels could not be arranged one on another.

16. The apparel folding device of claim 15 wherein said first upper side panel and said first lower side panel are hingedly connected to each other at all times and said second upper side panel and said second lower side panel are hingedly connected to each other at all times.

17. The apparel folding device of claim 15 wherein said first upper side panel is separated from said first lower side panel and said second upper side panel is separated from said second lower side panel.

18. The apparel folding device of claim 15 wherein said panel further comprises first and second end edges;

said apparel folding device further comprising a bottom panel hingedly engaged with said panel along said second end edge;

wherein said bottom panel is capable of being arranged upon said panel to facilitate shipping and storage of the apparel folding device.

* * * * *

UNITED STATES PATENT AND TRADEMARK OFFICE

CERTIFICATE OF CORRECTION

PATENT NO. : 6,814,269 B1
DATED : November 9, 2004
INVENTOR(S) : Juan Fernandez

It is certified that error appears in the above-identified patent and that said Letters Patent is hereby corrected as shown below:

Column 4,
Line 62, after "it" insert -- . --.
Line 62, after ". of" should read -- Of --.

Column 5,
Line 6, after "first" delete -- " --.
Line 42, after "(not shown)" insert -- . --.
Line 43, "of" should read -- Of --.

Column 8,
Line 55, "members" should read -- member --.

Signed and Sealed this

Fifth Day of April, 2005

JON W. DUDAS
*Director of the United States Patent and Trademark Office*